United States Patent [19]

Corain

[11] Patent Number: 4,600,039

[45] Date of Patent: Jul. 15, 1986

[54] PROCESS AND DEVICE FOR THE FORMATION OF A TUCKED SELVEDGE, ESPECIALLY SUITABLE FOR TERRY LOOMS

[75] Inventor: Luciano Corain, Vicenza, Italy

[73] Assignee: Nuovo Pignone S.p.A., Florence, Italy

[21] Appl. No.: 556,641

[22] Filed: Nov. 30, 1983

[30] Foreign Application Priority Data

Dec. 23, 1982 [IT] Italy ..... 24966 A/82

[51] Int. Cl.[4] ..... D03D 47/48

[52] U.S. Cl. ..... 139/434

[58] Field of Search ..... 139/25, 26, 434, 11, 139/24, 116, 429, 430

[56] References Cited

U.S. PATENT DOCUMENTS

| | | | |
|---|---|---|---|
| 3,441,059 | 4/1969 | Gotz et al. | 139/25 |
| 3,499,474 | 3/1970 | Pfarrwaller | 139/434 |
| 3,563,280 | 2/1971 | Cugini | 139/434 |
| 4,076,049 | 2/1978 | Manea | 139/434 |
| 4,078,586 | 3/1978 | Porter et al. | 139/434 |

FOREIGN PATENT DOCUMENTS

| | | | |
|---|---|---|---|
| 2705686 | 8/1978 | Fed. Rep. of Germany | 139/434 |
| 1501815 | 10/1967 | France | 139/434 |

*Primary Examiner*—Henry S. Jaudon
*Assistant Examiner*—T. Graveline
*Attorney, Agent, or Firm*—Hedman, Gibson, Costigan & Hoare

[57] ABSTRACT

Process for the formation of a tucked selvedge in a terry cloth piece, as obtained with the procedure using an articulated reed having two beating-up positions, using a selvedge-forming device which comprises a movable grasping and severing member as well as a second movable member in the form of a takeup hook or the like, characterized by the additional step of keeping said movable members through the entire time during which the weft threads inserted in the shed and beaten up by the reed up to the blind beat position are, in their turn, beaten by the comb against the fell of the fabric being woven. The selvedge-forming device for carrying out the process is then equipped with a weft-slackening humpy blade while its spring biased cam-controlled levers intended to drive said movable members are fitted, at their ends pivoted to the same shaft, with projections or teeth which are adapted to coact with corresponding stop abutments mounted on an arbor which is spring-biased and can be shifted by an electromagnet until bumping into said teeth. A preferred embodiment of a movable grasping and severing member is also described in detail.

5 Claims, 6 Drawing Figures

A
B
C
D
1
4
4'
4''
4'''
5
6
7
8
9
10
11
12
13
14
15
16
17
18
19
20
23
24
25
27
28
29
30
31
33
34
35
36
37
38
39
40
41
42
44
45
46
52
62
67
68
69
70
71
72
73
74
75
76
77
78
79
80
81
82
83
84
85
+
-

PROCESS AND DEVICE FOR THE FORMATION OF A TUCKED SELVEDGE, ESPECIALLY SUITABLE FOR TERRY LOOMS

This invention relates to a process for the formation of a tucked selvedge, which, by providing the feedback into the shed of the weft tails cut to size after a number of beats preselected at leisure rather than at every reed beatup, makes it possible to obtain, both simply and cheaply, functional and attractive selvedges even in terry cloths obtained by varying the reed beatup position.

The invention also relates to a device for carrying out said process, said device being capable of automatically preventing said weft tails from entering the shed again during the required stages by latching in their at rest position the several feedback mechanisms. As is known, the terry fabric is a fabric which is manufactured by interlacing the weft with two orderly sets of warps coming from two discrete warp beams, wherein the warp threads of a set are all fast and serve to provide with the picks the sturdy structure for the fabric, whereas the warp threads of the additional set, which are less fast than the former and are thus called the "loose warps" are intended, instead, for forming the characteristic loop pile of the terry cloth, as they are periodically looped every fourth or fifth reed beatup.

More detailedly, a few laid picks are first brought by the reed, by a blind beatup, at a few millimeters from the fell of the fabric being woven, whereafter they are beaten up together with a subsequently laid pick, by the reed against the fell by causing such picks to slide along the faster warps by so doing, the picks drag with them the loose warps so that the latter are looped between the reed and the fell and provide the terry loop pile structure.

The result aforementioned can be obtained in two different ways, namely: either by varying the reed beatup position, or by keeping said beatup position unaltered but varying the position of the fabric-warp assembly relative to beatup position.

On the other hand, a terry product is the more appreciable and thus more remunerative if it has sturdy edges to be obtained with tucked selvedges, the quality and the effect of the selvedge being also determining factors.

Now, in the case of the formation of the terry loops according to the second of the aforementioned procedures there is no problem in providing tucked selvedges, which can be obtained with the same selvedge-forming devices which are already known and are used for plain weave interlacing, inasmuch as the pick is left by the reed always in the same position. To adopt such a procedure, however, gives a poor quality terry as a rule, due to the disturbances brought about by the to-and-from motion of the warp.

Excellent terry fabrics, conversely, are obtained by forming the loops according to the first of the two procedures outlined above, whereby, however, the formation of the tucked selvedge proves to be exceedingly intricate and expensive. As a matter of fact, according to the articulated-reed approach, the picks are positioned either in a blind beatup position or in a beatup position and, moreover, the blind beatup position is varied, in its turn, as a function of the loop height as desired and should be the more arreared relative to the beatup position the higher the loop is to be. Summing up, the position of the laid and picked wefts is varied relative to the loom front frame on which the selvedge-forming device is to be mounted, so that the device, to be enabled to operate correctly, ought to the capable of taking different positions cyclically so as to reach the different picks. The fact that a device of the kind has never been constructed heretofore is a confirmation of its intricacy and its cost.

An objective of the present invention is just that of doing away with such drawback and of tendering, therefore, the possibility of manufacturing in a simple and cheap way tucked selvedges of the best quality and of attractive look which are such as to improve further the already very satisfactory terry fabrics that can be obtained with the procedure using an articulated reed having two beatup positions.

The background of the invention is the fact, which has been practically ascertained, that a fabric is still efficiently bound with sturdy edges even when the tails of the picks are brought back into the shed, rather than at every beatup, occasionally, after a number of reed beatups.

This observation, in point of fact, is such as to solve the problem aforesaid easily, in that it is now sufficient to bring back the weft ends only and exclusively after that they have been beaten up by the reed against the fabric fell, thus excluding the weft feedback during the blind beatup stages. Stated alternatively, when acting always in the single position which corresponds to the actual reed beatup, the feedback of the weft ends into the shed is delayed until such time as the weft threads which have been laid and carried by the reed to the blind beatup position are, they also, beaten up and thus brought to said single position.

More specifically, the process for the formation of a tucked selvedge in a terry fabric as obtained with the procedure which uses an articulated reed having two beatup positions comprises the steps of taking and firmly grasping the ends of the picks laid in the shed and beaten by the reed against the fell of the fabric being woven by means of a movable manner of a selvedge-forming mechanism, to sever by said member all said weft ends to a preselected length and wrap them around another movable member or hook for feeding back said selvedge-forming mechanism and causing said latter member to be brought back and consequently said weft ends by releasing the grasping pressure applied to said first movable member, is characterized, according to the invention, in that said movable members of said selvedge-forming mechanism are held inoperative during the entire time in which the picks laid in the shed and beaten up by the reed up to the blind beatup position are, in their turn, beaten up by the reed against said fell of the fabric being woven.

On the other hand, the possibility afforded by such a process of latching as desired in their at rest position the mechanism intended to feed back the weft ends to the shed, not only solves, as outlined above, in an easy way the problem of forming sturdy edges in a terry fabric as obtained with the procedure of the articulated reed having two beatup positions, but makes also possible the mass-production of high quality terry fabrics having tucked selvedges, the result being a considerable saving of time and a great economy in production. It is sufficient in fact, periodically to cut off the severing and the feedback of the weft tails also in correspondence with the beating up proper during the formation of double selvedges in the interior of the weaving zone so as to obtain, in such zone, a number of terry pieces having tucked selvedges and connected to each other but by said uncut weft threads which have not been fed back.

The selvedge-forming mechanism which is adapted to carry the process aforementioned into practice must thus be capable of maintaining in the inoperative positions the relative devices which effect the feedback of the weft ends during the feedback exclusion stage.

These devices consist of a movable grasping and weft cutting member having, impressed thereto, both a horizontal translational movement to go and grasp the weft ends and to cut them to size, and a rotation movement to wind said weft ends around a second movable member shaped as a hook or such like, to which, also, a translational movement is impressed concurrently with a rotational movement so as to enter the shed and to feed the weft threads thereinto.

Now, to prevent such a feedback from taking place, it is consequently required that the movable grasping and cutting member will not grasp and cut the weft, but remain, instead, in its inoperative position (arreared) so as not to interfere with the threads, so that it is necessary, that both its movement be excluded together with the rotation of the second movable member only. As a matter of fact, inasmuch as the hook or such like remains in a lifted position relative to the warp threads if it does not rotate, its translational movement can be allowed to take place unaltered, that is, not excluded.

On the other hand, the movements aforementioned are all controlled positively and independently from each other by discrete cams acting upon spring-biased springs which are fulcrumed at either end to the same shaft so that the exclusion aforementioned can be obtained, according to another feature of the present invention, on account of the circumstance that said levers have, at the end aforesaid, projections or teeth which are adapted to coact with corresponding stop abutments mounted on a spring-biased supporting arbor which can be shifted only axially relative to the shaft aforesaid, by the action of an electromagnet, and from a position in which said stop abutments engage said teeth, to a position in which they do not so.

As a matter of fact, whenever the electromagnet is deenergized, said arbor is shifted by the spring bias so that it brings its stop abutments in registry with said teeth of the levers, so that the levers are prevented from being rotated and cannot follow the motion of the relevant control cam, but remain inoperative in their arreared position. As the electromagnet, conversely, is energized, the arbor is shifted to the position in which its stop abutments no longer engage said teeth so that the movements outlined above can take place. The movable grasping and cutting member of the selvedge-forming mechanism aforementioned must, otherwise, be capable of providing the sequence of operations as is necessary for an efficient and reliable formation of a tucked selvedge, such as a reliable and efficient grasp of the pick tails, their severing to the desired length, a rotation along an arc of a circle to wind said tails about the feedback hook or such like while simultaneously carrying out a release of the grasp so as to facilitate the tail pulling out by said feedback hooklike member. According to a preferred embodiment of the present invention, said movable grasping and cutting member consists of scissors, the fixed upper blade of which is fast to an end of a rod which can horizontally be shifted by the agency of one of the spring-biased cam-controlled levers, whereas the lower blade is pivotally connected to the upper blade and is integral with a small vertical block which can be rotated by a rod pivoted at its own top end which can be horizontally shifted by the action of another of the aforesaid spring-biased and cam-controlled levers said block having on its lower surface a grasping plane against which a presser foot is held pressed by the concurrent action of two discrete springs mounted in the interior of a hollow space in the small block and, respectively, on the vertical shank of the presser foot and on another arbor parallel to the shank aforesaid, the spring mounted on the second named arbor being stiffer than the other one, Said shank and second arbor are then connected in their action by a bar, which, integral with the presser foot, acts like an abutment for the arbor spring and has the other arbor passed therethrough, the spring of which biases against the bar a stop integral with the other arbor, and, moreover, the top ends of said two arbors coact with an arm of an L-shaped lever which is pivoted at its middle point to the block whereas its other arm coacts with a resting hollow space which is formed on the fixed upper blade, the arbor having the stiffer spring being situated nearer to the pivotal point of the L-shaped lever.

Such a mechanism actually fulfils all the requirements which are essential for an efficient and reliable formation of a tucked selvedge because the two discrete springs ensure a reliable and efficient grasp of the weft thread tails, whereas the rotation of the small block along an arc of circle due to the combined motions of the two shiftable rods ensures the cut to the preselected length as well as the winding of the weft tails about the feedback hooklike member and, lastly, the pressure of the L-shaped lever onto the arbor having the stiffer spring only originates, as will best seen hereinafter, the expected release of the grip.

On the other hand, it is fitting to notice that the obtention of the movement of the movable grasping and cutting member from the combination of the actions of the two positive and independent controls by discrete cams enables such movable member to carry out any desired movement by merely phase-shifting the two control cams with respect to one another.

Lastly, in order to release the supertension of the weft threads inserted into the shed, which would tend, upon the severing of said threads, to shrink the fabric being woven thus causing the weft thread tails to escape the presser foot of the selvedge-forming mechanism, whereby the quality of the product would be seriously impaired, according to another feature of the present invention, said selvedge-forming mechanism is provided as having weft-slackening means which consist of a humpy vertical blade which juts perpendicularly to the picked weft threads.

As a matter of fact, inasmuch as the weft threads must follow the humpy blade edge, they are exploited along a longer thread length, that which obviously brings about a slackened tension of the thread themselves. The invention is now better explained with reference to the accompanying drawings, which show a preferred practical embodiment and is given by way of illustration only without any limitation, inasmuch as technical and constructional changes can always be adopted without departing from the basic idea of the present invention.

Figure 1:
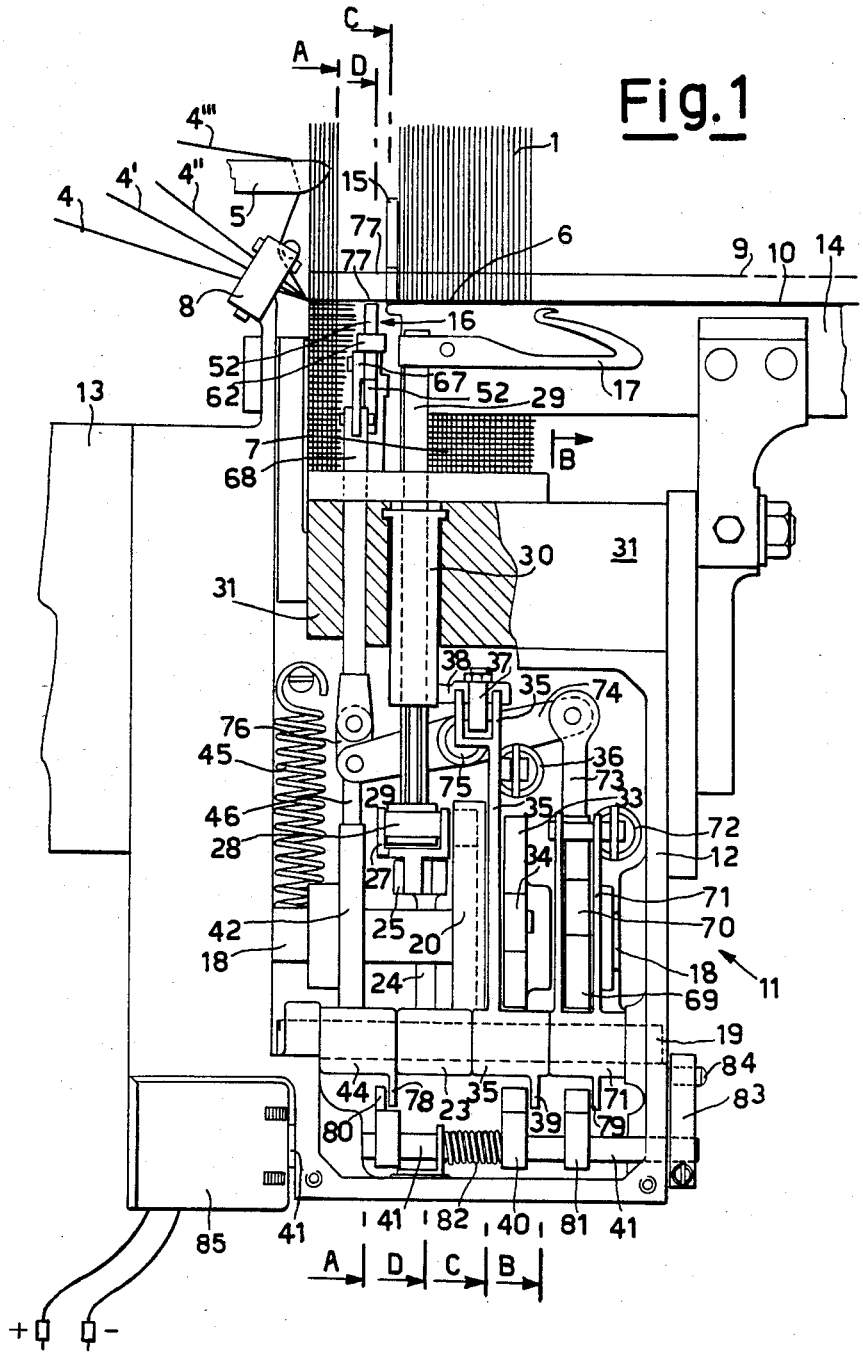
FIG. 1 is a top view of the selvedge-forming device according to the invention as applied in a process for the formation of a tucked selvedge in a terry cloth as obtained with the procedure of the articulated reed having two beatup positions, also according to the invention.

Having now reference to the drawings, the reference numerals 1 and 2 indicate the warp threads, fast and loose, respectively, which form the warp shed 3 whereinto the weft threads 4,4',4'' and 4''', coming from outside reels not shown in the drawing, are inserted in succession by the weft-inserting pincer 5 after having been cut out of the fell 6 of the terry fabric 7 being woven, by the action of the scissors 8. The terry cloth 7 in question is obtained by bringing, with a reed which is not shown in the drawing, two or three times the weft threads picked in the shed to a blind beatup position 9 (best seen in FIG. 1) and beating up the next time, still with the same reed, all the weft threads which have been inserted against the edge 10 of the terry cloth 7.

The tucked selvedge is obtained in such a fabric 7 with the selvedge-forming mechanism 11 the casing 12 of which is mounted on the breast plate 13 of the terry loom and there are secured thereto both the lid of the template 14 and a vertical humpy blade 15 which acts as a weft-slackening member inasmuch as, by forcing the weft threads to overtake its humpy edge, releases the final tension of such threads.

The selvedge-forming mechanism in question comprises a grasping and cutting movable member 16 as well as a second hook-like feedback movable member 17, both members having horizontal shift and rotational motions impressed thereto as obtained in a positive manner and independently of one another by discrete cams which are keyed to the same shaft 18 and act upon corresponding spring-biassed levers, the latter being, in their turn, keyed at either ends to the same shaft 19.

Figure 5:
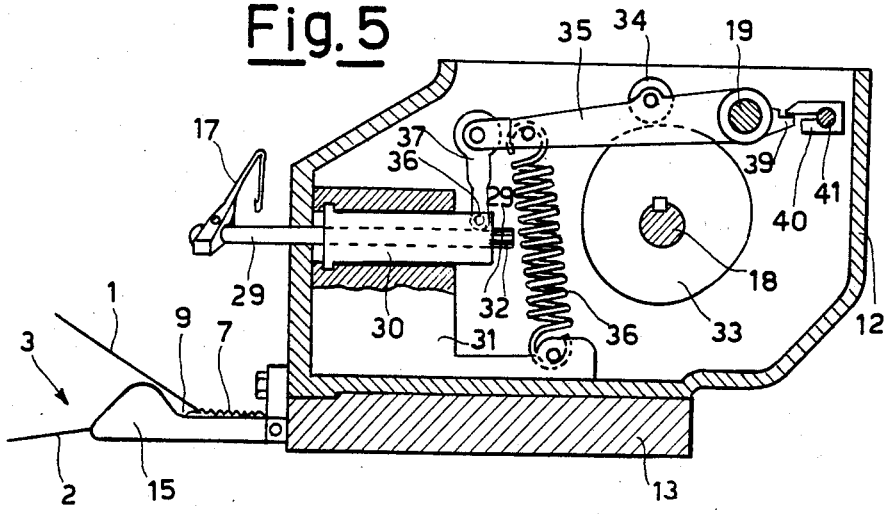
FIG. 5 shows a partial front sectional view taken along the line CC of FIG. 1.
Figure 6:
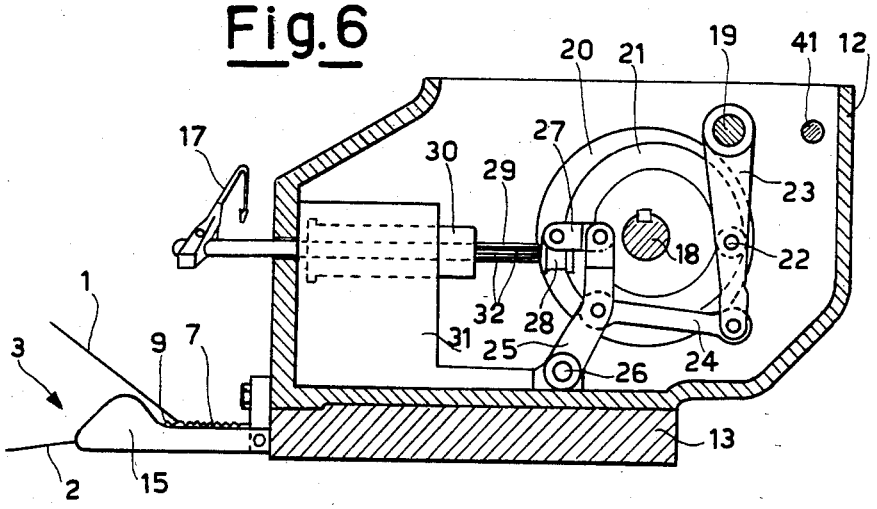
FIG. 6 is a partial front sectional view taken along the line DD of FIG. 1.

More detailedly, a cam 20 (best seen in FIG. 6) is keyed to the shaft 18 aforesaid and offers its internal groove 21 to cooperate with a follower 22 which is pivotally mounted at the middle point of a lever 23, the top end of which is fulcrumed to said shaft 19, whereas the other end, the lower one, is connected, by the pitman 24, to a lever 25: the latter, pivoted at 26 on a fixed portion of the casing 12, is pivoted at the opposite end, to a fork 27 which is likewise pivoted to a small block 28 which is secured to the end of a knurled shank 29 passed through a sleeve 30: the latter is supported for rotation only and not for translation, by a fixed supporting block 31 of the casing 12. The shank 29 which, by its knurled surface 32 is connected to the sleeve 30 for rotation only but can conversely be horizontally shifted, carries, then, secured to its opposite end said feedback hook-like member 17 which can be horizontally shifted by the action of the cam 20 aforesaid. The rotation of the feedback hooklike member 17, which is required to have it enter the warp so that the weft ends may be fed back, is originated, conversely, by the cam 33 (best seen in FIG. 5): cam 33, keyed to the shaft 8, coacts with the follower 34 of a lever 35 which is pivoted on the shaft 19 aforementioned, and is biassed downwards by the spring 36 and is linked by a pitman 37 to a pin 38 projecting from said sleeve 30. The lever 35, moreover, is equipped, in correspondence with its end which is pivoted to the shaft 19, with a projection or a tooth 39 adapted to cooperate with a stop abutment 40 mounted on a supporting arbor 41, the latter being arranged parallely of the shaft 19 aforesaid.

The horizontal shift of said grasping and cutting member 16 is then brought about (best shown in FIG. 2) by the cam 42 which is also keyed to the shaft 18 and cooperates with the intermediate follower 43 of a lever 44, the latter being likewise keyed to the shaft 19 and which, biassed by the spring 45 against the cam 42 aforesaid, acts, via the pitman 46, upon the end of a rod 47 which is borne for horizontal translation by said supporting block 31 of the casing 12 whereas to the opposite end of the rod 47 there is secured the fixed upper blade 48 of the scissors for the grasping and cutting member 16 aforementioned.

Figure 4:
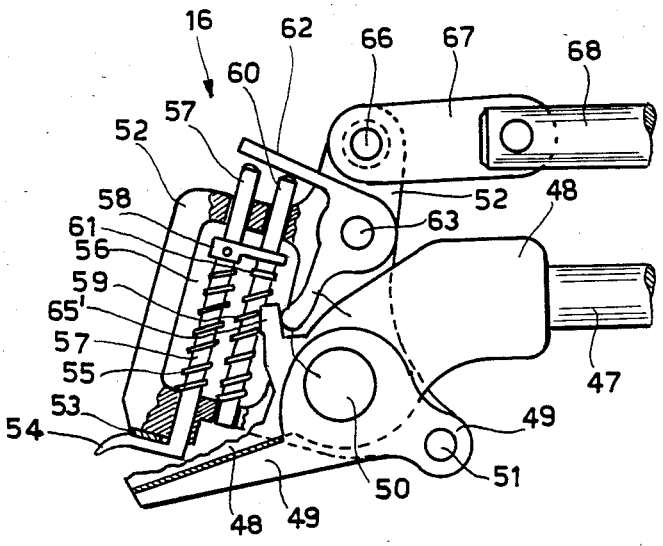
FIG. 4 shows a front sectional view on an enlarged scale of the movable grasping and cutting device of the selvedge-forming mechanism of FIG. 1, during the stage wherein the gripping pressure on the thread is being released.

The lower blade 49 of the scissors for the grasping and cutting member 16, conversely, is pivoted for rotation at 50 to the fixed blade and is integral, via a connection pin 51, with a vertical small block 52 having on its bottom surface, a gripping plane 53 (best seen in FIG. 4) against which a presser foot 54 is held urged by the bias of a spring 55, which is mounted, in the interior of a chamber 56 of the block 52, on the vertical arbor 57 of the presser foot 54, between the lower edge of the chamber 56 and a bar 58 integral with the arbor 57, the presser foot 54 being also pressed by the action of a second spring 59, stiffer and larger than 55 and mounted, still within the same chamber 56 of the block 52, on a second arbor 60: the latter, arranged parallely of the former arbor 57 and closer to the pivotal point 50, passes through the bar 58 and has a stop abutment 61 integral therewith which is biassed by the spring 59 upward against the bar 58. The top ends of said two arbors 57 and 60 are then in cooperation with an arm 62 of an L-shaped lever 62 pivoted at its middle point at 63 to said block 52, the other arm 64 of the L-shaped lever coacting with the edge 65 of a resting hollow space 65 formed on the fixed top blade 48. Furthermore, the top end of the vertical block 52 is pivoted at 66 to a pitman 67, which, in its turn, is pivoted to an end of a rod 68 which is supported for horizontal translation by said fixed support block 31 of the casing 12.

Figure 2:
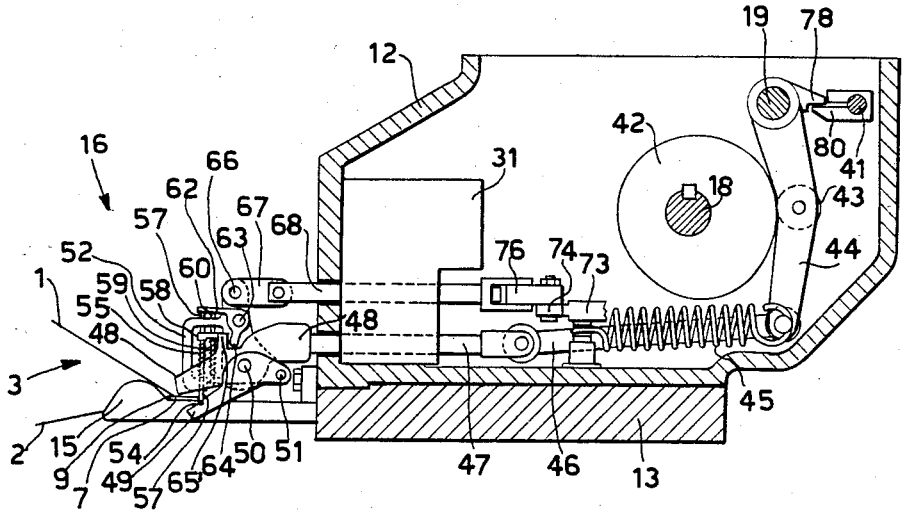
FIG. 2 shows a partial front sectional view taken along the line AA of FIG. 1.
Figure 3:
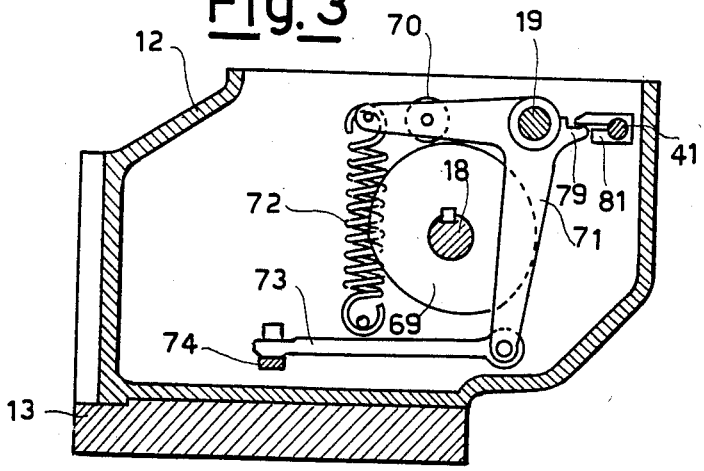
FIG. 3 is a partial front sectional view taken along the line BB of FIG. 1.

The translational motion of the rod 68 and the consequential rotation of the vertical block 52 and thus of the lower blade 49 is caused, finally, by a cam 69 which is keyed to said shaft 18, said cam 69 coacting (see FIG. 3) with the follower 70 of an L-shaped lever 71: the latter, pivoted in its middle point to the shaft 19 and biassed by the spring 72, is linked, by a pitman 73, to the end of a rocker 74 which is pivoted at 75 to the casing 12, the other end of 74 being linked, via the pitman 76, to the opposite end of the rod 68 aforesaid. The mode of operation of said movable grasping and cutting mechanism 16 can now be fully appreciated. In its starting position, said mechanism has its block 52 rotated counterclockwise and this is due to the coacting between the edge 65' of the chamber 65 of the fixed upper blade 48 and the arm 64 of the L-shaped lever (62–64) which brings about a consequential counterclockwise rotation of the L-shaped lever and the result is that the arm 62 of said L-shaped lever presses the arbors 57 and 60 and, by overcoming the bias of the springs 55 and 59, holds the presser foot 54 open as shown in FIG. 2.

As soon as the picked weft threads are beaten up from the blind beat position 9 against the fell 10 of the terry cloth 7 being woven (see FIG. 1), the grasping and cutting member 16 with the presser foot 54 open is caused to advance by the cam 42 (see FIG. 2) until becoming positioned with the ends 77 of the weft threads (see FIG. 1) in the interior of the opening as provided by the open presser foot. At this stage, the cam 69 (see FIG. 3) which controls the rod 68 produces a clockwise rotation of the block 52 and, thereby, that of the lower blade 49, the result being the closure of the scissors and the cutting to size of said weft ends. Simultaneously, the L-shaped lever (62–64), by becoming withdrawn from the edge 65', releases the springs 55 and 59 which keep the presser foot 54 tightly enough so that the severed ends of the weft threads inserted therein are tightly pressed against the grasping plane 53. The combined action of said two cams 42 and 69 causes a rotation and translation backward motion of the block 65 to take place and therewith also the presser foot 54 is moved and imparts to the tails or ends 77 of the weft threads a winding movement in the shape of an arc of a circle which effectively wraps them around the hook-like feedback member 17, as well as a slight forward rotation which acts so as to bring the arm 62 of the L-shaped lever (62–64) to press only onto the arbor 60 (see FIG. 4) thus neutralizing the bias of the stronger spring 59 onto the presser foot 54 the result being a release of the grip to encourage the unthreading of the tails 77 of the weft threads by said hook-like feedback member 17.

On the other end, both the lever 44 and the L-shaped lever 71 are also provided, in correspondence with their ends which are pivoted to the shaft 19, with a projection or a tooth, 78 and 79 respectively, which is adapted to coact with a stop abutment, 80 and 81, respectively, both mounted on said supporting shaft 41 which, in its turn, is slidebly and axially supported by the casing 12. Said shaft 41 is biassed by a spring 82 (see FIG. 1) so as to bring its stop abutments 80,40 and 81 to engage the corresponding teeth, 78,39 and 79 of the control levers 44,35 and 71, and is prevented from being rotated by a fork 83 integral with it, which embraces a stop pin 84 integral with the casing 12 and can be shifted axially by an electromagnet 85. By so doing, in order to obtain that the movable grasping and cutting member 16 and the feedback hook 17 of the selvedge-forming mechanism 11 be actuated only when the picked weft threads are beaten against the fell 10 of the fabric being woven, as is required in the case of terry cloths obtained with the procedure using an articulated reed with two beatup positions, what is necessary is only to energize the electromagnet 84.

I claim:

1. An apparatus for forming a tucked selvedge on a terry cloth fabric produced on a loom having an articulated reed with two beat-up positions in which a plurality of weft threads are inserted into successive warp sheds, comprising:

(a) moveable means for grasping and cutting said weft ends, said moveable means having both linear and rotational movement;

(b) means for slackening said weft threads while grasped by said moveable means;

(c) a moveable hook-like member having linear and rotational movement for receiving said cut weft ends from said grasping and cutting means and reintroducing said weft ends into a successive warp shed, wherein said grasping and cutting means and said hook-like member are driven independently of one another by discrete cams in cooperation with a plurality of spring-biased levers fulcrummed at either end to a common shaft, said levers being further provided with projections or teeth adapted to cooperate with corresponding stop abutments mounted on a spring biased arbor which is displaceable in a parallel and axial direction to said common shaft; and (d) an electromagnet for engaging or disengaging said teeth of said levers with said corresponding stop abutment so as to render said moveable grasping and cutting means motionless.

2. The apparatus of claim 1, wherein said means for slackening said weft threads consists of a vertical humpy blade perpendicularly disposed to said weft threads.

3. The apparatus of claim 1, wherein said moveable grasping and cutting member includes a scissors having an upper and lower blade, said upper blade being fixed and integral with one end of a first rod which can be shifted horizontally by the action of one of said cam-controlled spring-biased levers, whereas said lower blade is pivoted to said upper blade and is integral with a vertical small block which can be rotated by the action of a second rod pivoted at its upper end and horizontally shiftable by the action of a second of said cam-controlled spring-biased levers, said small block having in its lower section a gripping plane against which a presser foot is held pressed by the combined action of two discrete springs mounted within a chamber of said block, said first spring mounted on a vertical shaft of said presser foot, and said second spring mounted on a second shaft parallel to said vertical shaft of said presser foot and coupled therewith in the upward motion, the top ends of said two shafts being in cooperation with a first arm of an L-shaped lever pivoted at its middle point to said block, a second arm of said L-shaped lever positioned in a resting hollow space formed in said upper blade.

4. The apparatus of claim 3, wherein said second spring mounted on said second shaft is stiffer than said first spring mounted on said vertical shaft of said presser foot and is further positioned closer to said L-shaped pivot point.

5. The apparatus of claim 3, wherein said second shaft is coupled to said vertical shaft of said presser foot by a bar which is integral to said vertical shaft thereby providing an abutment for said first spring, said bar having a bore extending therethrough for passage of said second shaft wherein said second spring is biased against said bar.

* * * * *